US008288674B2

(12) United States Patent
Kantas et al.

(10) Patent No.: US 8,288,674 B2
(45) Date of Patent: Oct. 16, 2012

(54) WINDING FOR A CONTACT OF A MEDIUM-VOLTAGE VACUUM CIRCUIT-BREAKER WITH IMPROVED ENDURANCE, AND AN ASSOCIATED CIRCUIT-BREAKER OR VACUUM CIRCUIT-BREAKER, SUCH AS AN AC GENERATOR DISCONNECTOR CIRCUIT-BREAKER

(75) Inventors: Saïd Kantas, Le Cres (FR); Bruno Berthon, Saint-Aunès (FR); Cédric Triaire, Saint Martin de Londres (FR)

(73) Assignee: Areva T&D SAS, Paris la Defense Cedex (FR)

( * ) Notice: Subject to any disclaimer, the term of this patent is extended or adjusted under 35 U.S.C. 154(b) by 122 days.

(21) Appl. No.: 12/792,635

(22) Filed: Jun. 2, 2010

(65) Prior Publication Data

US 2011/0073566 A1 Mar. 31, 2011

(30) Foreign Application Priority Data

Jun. 10, 2009 (FR) ..... 09 53855

(51) Int. Cl.
*H01H 33/66* (2006.01)

(52) U.S. Cl. ..... 218/128; 218/118

(58) Field of Classification Search ..... 218/128–129, 218/118, 874

See application file for complete search history.

(56) References Cited

U.S. PATENT DOCUMENTS

| | | | | |
|---|---|---|---|---|
| 4,052,577 | A | 10/1977 | Votta | |
| 4,109,123 | A | 8/1978 | Lipperts | |
| 4,117,288 | A | 9/1978 | Gorman et al. | |
| 4,210,790 | A * | 7/1980 | Kurosawa et al. | 218/127 |
| 4,334,133 | A | 6/1982 | Gebel et al. | |
| 4,390,762 | A | 6/1983 | Watzke | |
| 4,453,054 | A * | 6/1984 | Peche et al. | 218/128 |
| 4,459,446 | A * | 7/1984 | Wolf | 218/123 |
| 5,597,993 | A | 1/1997 | Yorita et al. | |
| 5,691,521 | A | 11/1997 | Komuro et al. | |
| 5,691,522 | A | 11/1997 | Schulman et al. | |
| 5,726,406 | A | 3/1998 | Bolongeat-Mobleu et al. | |
| 6,048,216 | A | 4/2000 | Komuro et al. | |
| 6,072,141 | A | 6/2000 | Slamecka | |

(Continued)

FOREIGN PATENT DOCUMENTS

DE 19503661 7/1996

(Continued)

OTHER PUBLICATIONS

Yanabu S. et al., "Recent Technical Developments of High-Voltage and High-Power Vacuum Circuit Breakers," Toshiba Publication, Proceedings ISDEIV, 1998, pp. 131-137.

(Continued)

*Primary Examiner* — Truc Nguyen

(74) *Attorney, Agent, or Firm* — Nixon Peabody LLP

(57) ABSTRACT

A copper-based winding implementing a copper-based winding of diameter that is typically greater than 90 mm, designed to generate a magnetic field in an electrical contact for a medium-voltage vacuum circuit-breaker. The winding is constituted by a hollow cylinder including helical slots about its longitudinal axis and opening out both into the hollow and to the exterior of the cylinder, winding in which the space between two consecutive slots that form a turn is empty of material and the width of each initial slot is less than 1 mm.

15 Claims, 7 Drawing Sheets

U.S. PATENT DOCUMENTS

| | | | | |
|---|---|---|---|---|
| 6,140,599 | A * | 10/2000 | Haas | 218/123 |
| 6,479,778 | B1 * | 11/2002 | Kimura et al. | 218/118 |
| 6,740,838 | B2 * | 5/2004 | Matsui et al. | 218/118 |
| 6,747,233 | B1 | 6/2004 | Glinkowski | |
| 6,870,118 | B2 * | 3/2005 | Nishijima et al. | 218/128 |
| 7,250,584 | B2 * | 7/2007 | Asmus et al. | 218/128 |
| 7,642,923 | B2 | 1/2010 | Ploechinger | |
| 7,721,428 | B2 * | 5/2010 | Stoving et al. | 29/874 |
| 2010/0220418 | A1 | 9/2010 | Willieme et al. | |
| 2011/0000887 | A1 | 1/2011 | Schlaug et al. | |
| 2011/0006041 | A1 | 1/2011 | Schlaug et al. | |
| 2011/0073566 | A1 | 3/2011 | Kantas et al. | |

FOREIGN PATENT DOCUMENTS

| | | |
|---|---|---|
| DE | 10158576 | 6/2003 |
| EP | 0155376 | 9/1985 |
| GB | 1483899 | 8/1977 |
| JP | 01309224 | 12/1989 |
| JP | 04174919 | 6/1992 |
| JP | 06103859 | 4/1994 |
| JP | 2000208009 | 7/2000 |
| JP | 2009032481 | 2/2009 |
| WO | 2007082858 | 7/2007 |
| WO | 2007110251 | 10/2007 |

OTHER PUBLICATIONS

"Physical and Theoretical Aspects of a New Vacuum Arc Control Technology," Toshiba Publication, Proceedings ISDEIV, 1998, pp. 416-422.

French Preliminary Search Report in French Patent Application No. FR 0953855, mailed Feb. 3, 2010.

French Preliminary Search Report in French Patent Application No. FR 0953853, mailed Jan. 14, 2010.

French Preliminary Search Report in French Patent Application No. FR 0953852, mailed Jan. 15, 2010.

Notice of Allowance in U.S. Appl. No. 12/792,610, mailed Dec. 22, 2011.

Notice of Allowance in U.S. Appl. No. 12/792,626 mailed Jan. 3, 2012.

* cited by examiner

WINDING FOR A CONTACT OF A MEDIUM-VOLTAGE VACUUM CIRCUIT-BREAKER WITH IMPROVED ENDURANCE, AND AN ASSOCIATED CIRCUIT-BREAKER OR VACUUM CIRCUIT-BREAKER, SUCH AS AN AC GENERATOR DISCONNECTOR CIRCUIT-BREAKER

CROSS REFERENCE TO RELATED APPLICATIONS OR PRIORITY CLAIM

This application claims priority of French Patent Application No. 09 53855, filed Jun. 10, 2009.

TECHNICAL FIELD

The invention relates to medium-voltage vacuum circuit-breakers, sometimes called vacuum bottles.

It relates more particularly to improving the endurance of such vacuum circuit-breakers.

The main application is that in which vacuum circuit-breakers are used as switches in alternating current (AC) generator disconnector circuit-breakers at the output of a power station.

PRIOR ART

Vacuum circuit-breakers have been used for very many years in medium-voltage electrical distribution switchgear to break short-circuit currents of the order of a few kiloamps (kA), typically 25 kA, at a few kilovolts (kV), typically 36 kV. In that type of distribution switchgear, vacuum circuit-breakers must also withstand the continuous current, typically of the order of 1250 amps (A), without overheating. The way they are implanted in the distribution network is such that those vacuum circuit-breakers are closed in normal operation of the network and carry the continuous nominal current.

It is known in the art that in order to break such short-circuit currents, it is necessary to design the arc contacts so that intense axial (AMF) or radial (RMF) magnetic fluxes are generated at their facing ends in order to extinguish the arc upon separation of the contacts.

The higher the short-circuit current, the higher the generated magnetic flux must be, with an optimum distribution between contacts that is as uniform as possible over their surfaces, in order to obtain efficient arc extinction.

In order to obtain the flux or magnetic field (AMF or RMF) it is known in the art to implant a winding made of copper to constitute the body of an arc contact.

Thus, for example, the Applicant knows how to implement windings made of copper, each of which is constituted by a hollow cylinder provided with helical slots made about its longitudinal axis and opening out both to the hollow and to the exterior of the cylinder.

However, in order to be able to break very high currents, such as those found in AC generator disconnector circuit-breakers, in particular at the output of a power station, the Applicant has been obliged to increase the diameter of the contacts (contacts that are called "large diameter contacts" when their diameter is greater than 35 millimeters (mm)).

The Applicant has observed that, when using existing technology, it is not practical to make copper slotted hollow cylinders with large diameters, typically lying in the range 90 mm and 150 mm, in order to achieve the desired magnetic field. The machines for machining with metal slitting saws that are currently used for manufacturing windings do not allow slots to be made with a width of at least 1 mm.

However, with such slots, it is found that the drawbacks of large-diameter hollow cylinders and of vacuum circuit-breaker contacts incorporating such cylinders are numerous:

- firstly, being intrinsically more fragile, the cylinders are more complicated to handle during contact production, to transport, and to store: and that may lead to them being distorted and/or may cause them to suffer variation in their height that is not desired;
- the width of the slots, (the gap between two consecutive turns) of millimeter order or greater allows the turns to move too much in the longitudinal direction, during opening/closing cycles. This leads to a reduction in the mechanical endurance performance of large diameter contacts in a vacuum circuit-breaker that is incompatible with ANSI and CEI standards;
- finally, the magnetic fields that need to be generated effectively for extinguishing an arc have proven to be inadequate for large diameter windings.

In order to overcome these drawbacks, the Applicant has evaluated and tested two main solutions.

A first solution, for a desired magnetic field value, consists in reducing the number of slots with a view to increasing the mechanical endurance and strength of the winding.

That solution proved undesirable because reducing the number of slots amounts to reducing the number of turns defined individually between two consecutive slots.

This affects the magnetic field that is generated: for equal outside diameter, the strength of the field and its surface uniformity (symmetry) are degraded with decreasing number of turns.

A second solution consists in placing shim in the slots in order to counter to some extent the gaps inherent to these slots.

The shim is either made from a material that is electrically insulating or from a material that has electrical resistivity that is high relative to copper.

The addition of this shim, naturally leads to an increase in the cost of manufacturing the contact.

Further, with shim made from electrically insulating material, there is a great risk that particles of the material may become detached when the vacuum circuit-breaker is operated. The detachment of such particles will inevitably damage the dielectric strength of the vacuum circuit-breaker.

An object of the invention is to propose a design for a copper-based winding for generating a magnetic field in an electrical contact for a medium-voltage vacuum circuit-breaker that mitigates the drawbacks of the above-mentioned solutions.

A particular aim of the invention is thus to propose a copper-based winding that makes it possible simultaneously:

- to increase the mechanical endurance of a contact that incorporates the winding and that is of large size, typically lying in the range 90 mm to 150 mm;
- to generate a strong magnetic field without degrading the uniformity of the magnetic field at the surface of the contact; and
- to avoid any risk of distortion and/or variation in height while the winding is being manipulated.

SUMMARY OF THE INVENTION

To do this, the invention provides a copper-based winding, of diameter greater than 90 mm, intended to create a magnetic field in an electrical contact for a medium voltage vacuum circuit-breaker, the winding consisting of a hollow cylinder including helical slots made methodically about its longitudinal axis and opening out both to the hollow and to the exterior of the cylinder.

According to the invention, the space between two consecutive turns that constitutes a slot is empty of material and the width of each slot is less than 0.2 mm for an outside diameter $Ø_{ext}$ of the hollow cylinder that is greater than 90 mm. In the framework of the invention, the expression "empty of material" does mean that no solid element is present in a slot.

By making slots of individual width of less than less than 0.2 mm for an outside diameter of the hollow cylinder that is greater than 90 mm in a methodical manner, the mechanical endurance of a vacuum circuit-breaker including two windings of the invention (one winding per contact) is increased by a factor of at least ten relative to a prior art vacuum circuit-breaker.

The ANSI and CEI standards in effect for medium-voltage vacuum circuit-breakers are thus complied with. The slot widths reduced to below one millimeter avoid rupture of the turns during opening/closing cycles that cause strong impacts.

Further, windings of the invention are easier to manipulate and store than prior art windings.

The magnetic flux (field) generated by a winding of the invention implanted in a medium-voltage contact is uniform, i.e. symmetrical and constant, and it is of a high value.

Also preferably, the width of a turn is on average at least 3 mm, and typically greater than 4 mm.

The invention also relates to a method of making a copper-based winding, intended to generate a magnetic field in an electrical contact for a medium voltage vacuum circuit-breaker, the method comprising the following steps:

a) making a hollow cylinder of an initial height h1 with helical slots about its longitudinal axis and opening out both to the hollow and to the exterior of the hollow, the space between two consecutive turns that constitutes a slot being empty of material and the width of each initial slot being greater than 1 mm;

b) compressing the hollow cylinder until it reaches a calibrated intermediate height h2 so that after release of compression of the hollow cylinder, the width of each final slot is less than 1 mm.

Compression step b) of the method may take place cold with the compression release also being carried out cold by natural relaxation of the hollow cylinder.

In a variant:

step a) may be carried out with an initial individual slot width lying in the range 1 mm and 1.2 mm for an outside diameter of the hollow diameter $Ø_{ext}$ of the hollow cylinder greater than 90 mm; and step b) may be carried out such that the width of each final slot is less than 0.2 mm.

Advantageously, the compression step b) may also be carried out "hot" when an electrical contact for a medium-voltage vacuum circuit-breaker is being made.

Such a contact extends along a longitudinal axis Y and includes:

a mechanical connection portion that extends along a longitudinal axis Y;

a contact body comprising a winding consisting of a hollow cylinder that includes helical slots about its axis and opening out both to the hollow and to the exterior of the cylinder, the space between two consecutive turns that constitutes a slot is empty of material and the width of each is less than 1 mm, the first hollow cylinder being centered on the longitudinal axis Y by having an end that is fastened to the mechanical connection portion, the hollow of the first cylinder being empty of material; and a circular contact plate that has a diameter equal to the outside diameter of the first hollow cylinder, said plate also being centered on the longitudinal axis Y and being fastened to the end of the first hollow cylinder opposite the plate fastened to the mechanical connection portion.

In the method of making a the contact of the invention, the fastening of the hollow cylinder to the circular contact plate and to the mechanical connection portion is carried out by brazing, and during the brazing cycle, step b) of the method of making a winding is carried out as described above.

In other words, the method of brazing the various components of a contact together is advantageously used to carry out the controlled compression, or in other words the forming, of the winding.

Thus, means are set in place within the brazing oven that enable both the distortion and the height of the winding to be controlled.

The main advantage of this method is that a winding of the invention is obtained that has a slot width that is less than one millimeter, without adding time to the duration of a cycle of the method of fabricating a contact, and without noticeably increasing the cost thereof.

In other words, the forming by compression at high-temperature enables the compression to be controlled and can be incorporated in the already-established method of fabricating vacuum circuit-breakers.

Thus, the compression (forming) of copper-based windings in accordance with the invention can be done before or during a method of making a contact in a high-temperature oven while its various components are being brazed together. The height of the winding is thus reduced to a precise calibrated value by means of a support spacer or by standard tooling.

Typically, during the forming by compression of the winding, the winding loses 10% to 20% of its initial height. The width of the slots obtained can be less than 0.1 mm, which corresponds to a reduction factor of 10 to 12 relative to widths of winding slots in the prior art.

A person skilled in the art understands that in spite of all the precautions taken, it is possible that after compression, two adjacent turns may touch each other at a few points, i.e. the width of the slot that separates them may in some instances be zero at a few points.

The operation and performance of the vacuum circuit-breaker nonetheless remain unchanged. At the points of contact (if any) between two turns, said turns have substantially the same electrical resistance, they are therefore at the same potential and the current in the vacuum circuit-breaker cannot flow from one turn to the other or else, if there is any flow it is negligible.

Validation tests have demonstrated the effectiveness of compressing the winding of the invention, i.e. obtaining a calibrated gap between two adjacent turns that is less than 1 mm with the exception of some rare possible points of contact.

The invention also provides an electrical contact for a medium-voltage vacuum circuit-breaker extending along a longitudinal axis Y and comprising:

a mechanical connection portion that extends along a longitudinal axis Y; and a contact body that includes:

a first winding as described above; and a circular plate that has a diameter equal to the outside diameter of the first hollow cylinder, said plate also being centered on the longitudinal axis Y and being fastened to the end of the first hollow cylinder opposite from the end fastened to the mechanical connection portion.

In an advantageous embodiment, the contact includes a second winding, of an arrangement that is the subject matter of the patent application filed by the Applicant under the number FR 09 53849.

This second winding is thus connected electrically in parallel with the first winding and is adapted to generate a magnetic field that is superposed on the magnetic field generated by the first winding.

In a first variant, the second winding may be constituted by a winding of the invention, with each slot having a width of less than one millimeter.

The second hollow cylinder is thus centered on the longitudinal axis Y, concentric with the first cylinder, having one end fastened to the mechanical connection portion and the other end fastened to the circular plate, the hollows of the cylinders being empty of material.

In another variant, the second winding is constituted by an additional solid part comprising two cylindrical portions and an annular ring that is not looped and that is centered on the two cylindrical portions, each non-looped end of the ring being fastened by an arm to one of the cylindrical portions. The arrangement of this additional part is such that the two cylindrical portions are centered on the longitudinal axis Y and the annular ring is concentric with the first winding. One cylindrical portion is fastened to the mechanical connection portion and the other cylindrical portion is fastened to the circular contact plate.

The hollow of the first winding and the space between the annular ring and the solid cylindrical portions are empty of material.

In an advantageous embodiment, the contact includes at least one stud distinct from the winding(s), and of an arrangement that is the subject matter of the patent application filed by the Applicant under the number FR 09 53853. The stud is thus arranged in the hollow of the first cylinder, as a spacer between the mechanical connection portion and the circular plate of the contact body in such a manner as to avoid the collapse thereof during a closing operation and in the closed position of the vacuum circuit-breaker, the stud(s) having high electrical resistance such that when a given current flows in the contact, the amount of current that flows in the stud(s) is negligible relative to the current that flows in the winding(s).

A stud can thus be used as a calibrating spacer for the hot compression forming of the winding during the assembly by brazing of the complete contact. In other words, at the time of assembly the stud can be initially housed in the hollow of the winding cylinder and provide a calibrated gap between the stud and the contact plate and the mechanical connection portion.

The compression on either side of the contact plate and of the mechanical connection portion is thus limited by the precise height of the stud that corresponds to the winding height with slots of width less than one millimeter.

The outside diameter of the first winding and of the circular plate lies in the range 90 mm and 150 mm, which is perfectly suited to an application in which the short-circuit currents to be broken have a value that is not less than 63 kiloamps (kA).

The invention also provides a medium-voltage vacuum circuit-breaker including at least one electrical contact as described above.

The vacuum circuit-breaker may include a pair of electrical contacts comprising a stationary contact as described above and a movable contact as described above.

The invention also provides a circuit-breaker, such as an AC generator disconnector circuit-breaker, including at least one vacuum circuit-breaker as described above.

As a function of the application, a vacuum circuit-breaker of the invention naturally passes the short-circuit current and may optionally also pass the nominal load current.

BRIEF DESCRIPTION OF THE DRAWINGS

Other advantages and features of the invention emerge more clearly on reading the detailed description given by way of non-limiting illustration with reference to the following figures, in which.

DETAILED DESCRIPTION OF PARTICULAR EMBODIMENTS

Figure 1:
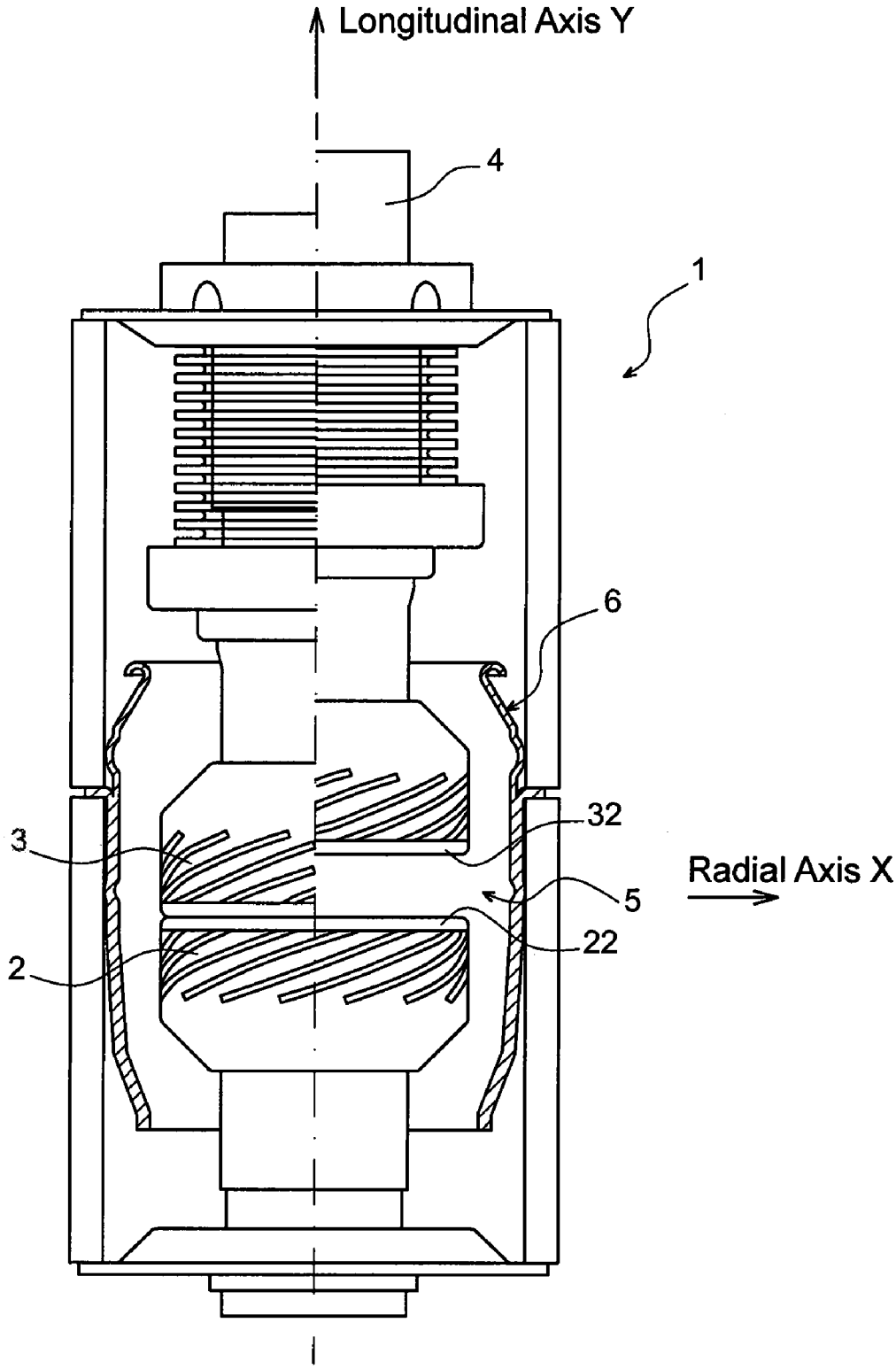
FIG. 1 is a view partly in vertical section of a medium-voltage vacuum circuit-breaker of the invention.

As shown in FIG. 1, a vacuum circuit-breaker 1 of the invention has a longitudinal axis Y and essentially includes a pair of contacts, of which one contact 2 is stationary and the other contact 3 is moved by an operating rod 4 between an open position (the portion shown on the right-hand side) and a closed position (the portion shown on the left-hand side). The contacts 2 and 3 are of large size (diameter >35 mm).

The contacts 2, 3 in a vacuum circuit-breaker are usually separated to extinguish an arc that is liable to be produced in the space 5 between these contacts Whether in the closed position or the open position, the contacts 2, 3 are inside a shield 6 that is itself inside the jacket 7 of the circuit-breaker, within which there is a vacuum Breaking high alternating currents requires the arc that is generated to be controlled.

The arc control means are usually an integral part of the vacuum circuit-breaker. They must therefore ensure that the energy density of the arc at the contacts 2, 3 remains below acceptable limits in order to be able to break the current and to withstand the transient recovery voltage.

One known type of arc control is axial magnetic field (AMF) arc control.

This entails generating a magnetic field parallel to the longitudinal axis Y of the bottle 1.

These arc control means are supposed to prevent contraction of the arc and consequently to enlarge it over an area of the facing surfaces of the contacts that is as large as possible. The normal result of this is to distribute the energy of the arc over a larger area and thus to enable the current to be broken at the natural zero-crossing of the alternating current.

In other words, in order to diffuse the arc effectively over the facing contact surfaces, efficient AMF arc control requires the production of a high and uniformly distributed magnetic field that is really generated by the winding.

Figure 2:
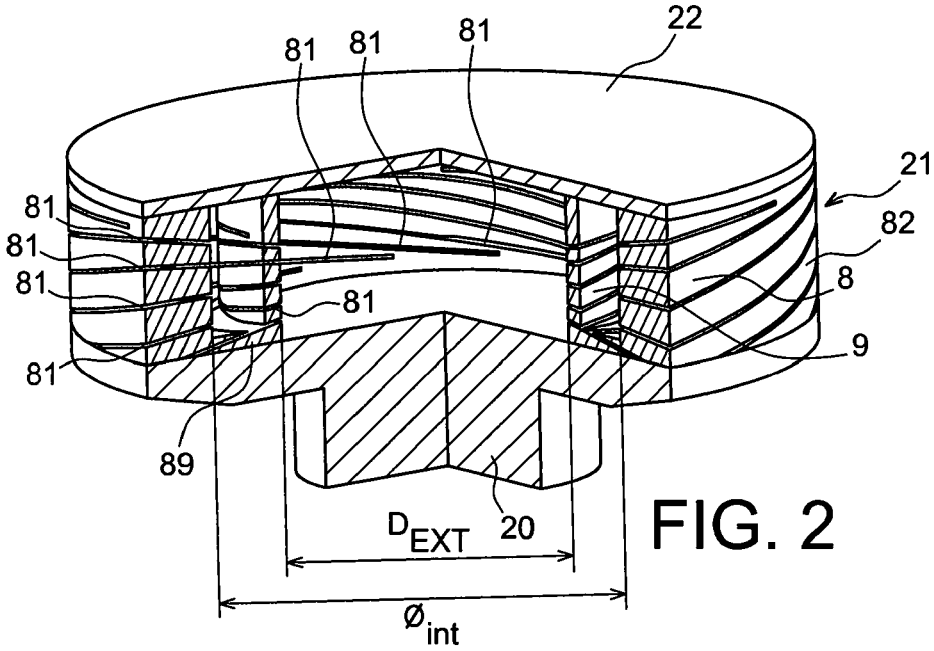
FIG. 2 is a part-sectional perspective view of a contact in an embodiment comprising a copper-based winding of the invention.

Thus these AMF arc control means are constituted by a component in the form of a coil or winding that consists of a hollow cylinder 8 arranged as shown in FIG. 2, i.e. at the periphery of the contact.

The hollow 80 of the winding 8 is empty of material. The hollow cylindrical winding 8 includes helical slots 81 around the longitudinal axis Y and opening out both to the inside and to the exterior of the cylinder 8. The space between two consecutive slots 81 is defined by a turn 82.

Each contact 2, 3 includes a mechanical connection portion 20, 30 and a contact body 21, 31 fastened to this mechanical connection.

The body 21, 31 includes the winding 8 and an electrode portion 22, 32 in the form of a circular plate. This plate 22 or 32 constitutes the surface of mutual physical contact with the other plate 32 or 22 when the contacts are in the closed position.

These contact surfaces 22, 32 are therefore those over which the arc must be diffused as uniformly and as widely as possible.

Each winding 8 is fastened both to the mechanical connection portion 20 or 30 and to the circular plate 22 or 32.

The windings 8 and electrode portions 22, 32 of the invention typically have an outside diameter $Ø_{ext}$ lying in the range 90 mm to 150 mm to break currents that are not less than 63 kA, e.g. 80 kA or higher.

Such an application that is particularly targeted is one in which the vacuum circuit-breaker is used as an AC generator circuit-breaker at the output of a power station.

Figure 3:
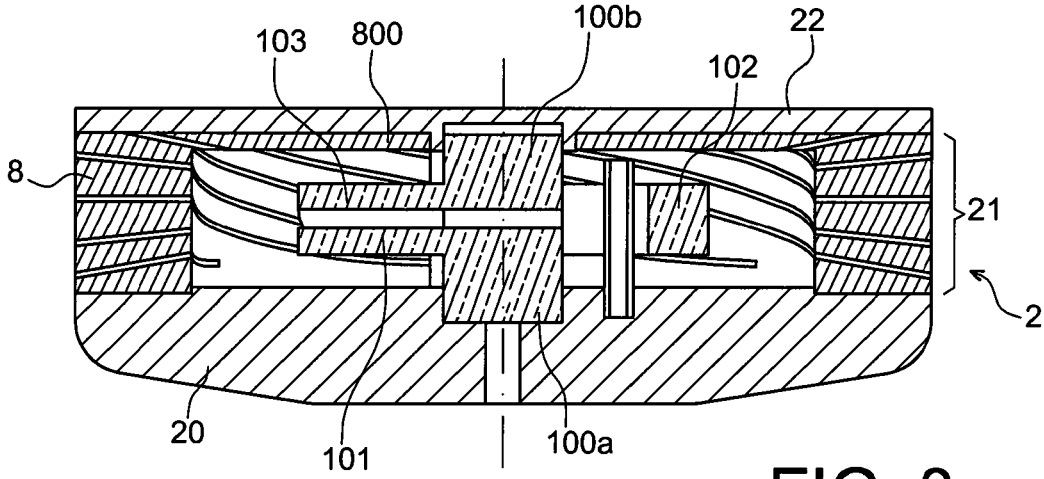
FIG. 3 is a view in longitudinal section of a contact of an another embodiment comprising a copper-based winding of the invention.

In order to increase the effective total magnetic field in the central portion of the contact, for contacts 2, 3 of large diameter (lying in the range 90 mm to 150 mm) or in other words in order to improve the effectiveness of the means for controlling the arc by the axial magnetic field AMF, the inventors propose as claimed in the patent application filed under the number FR 09 53849 a second winding 9 or 10 that is coaxial with the first winding 8 (FIGS. 2, 3, and 6).

This second winding 9 or 10 is thus connected electrically in parallel with the first winding 8 and is adapted to generate a magnetic field that is superposed on the magnetic field generated by the first winding 8.

An embodiment of a second winding is shown in FIG. 2

It consists of a second hollow cylindrical winding 9 including helical slots 91 around its axis and opening out both to the inside and the exterior of the cylinder. The second hollow cylinder 9 is centered on the longitudinal axis Y, concentric with the first cylinder 8, and having one end fastened to the mechanical connection portion and the other end fastened to the circular plate 22.

In this embodiment, the hollows 80, 90 of the cylinders are empty of material.

As shown, the second hollow cylinder 9 is in fact geometrically similar to the first hollow cylinder 8.

The two windings 8 and 9 are connected electrically in parallel: thus the two cylinders are fastened to the connection base 20 and to the electrode plate 22. The same applies for the windings (not shown) of the contact 3 opposite the contact 2.

Because the winding 8 at the periphery and the winding 9 at the center of the contact 2 constitute electrical resistances in parallel, given percentages of the current pass through each of the windings 8 and 9.

Another implementation of a second winding 10 is shown in FIG. 3.

In this embodiment, the second winding consists of an additional solid part 10 comprising two cylindrical portions 100*a*, 100*b* and an annular ring 102 that is not looped and that is centered on the two cylindrical portions 100*a*, 100*b*. Each non-looped end of the ring 102 is fastened by an arm 101, 103 to one of the cylindrical portions 100*a*, 100*b*.

There is a minimum distance between the two ends of the annular ring and this distance therefore has no influence on the value of the magnetic field generated by the second winding 10.

The arrangement of this additional part 10 is such that the two solid cylindrical portions 100*a* and 100*b* are centered on the longitudinal axis Y and its annular ring 102 is concentric with the first cylinder 8.

One solid cylindrical portion 100*b* is fastened to the mechanical connection portion 20 and the other cylindrical portion 100*b* is fastened to the circular contact plate 22.

The hollow 80 of the first cylinder 8 and the space between the annular ring 102 and the cylindrical portions 100*a* and 100*b* are empty of material.

As can be seen in FIG. 3, in order for the current in the additional winding 10 and the current in the first winding 8 to flow in the same direction in the ring 102 (upward and anti-clockwise), the arm 103 that fastens the end 1020 of the ring 102 to the cylindrical portion 100*b* is below the arm 101 that fastens the other end 1021 of the ring 102 to the cylindrical portion 100*a*.

A particular aim of the invention is thus to propose a first copper-based winding 8 that:

- increases the mechanical endurance of a contact 2, 3 that incorporates the winding, which contact is of large size typically lying in the range 90 mm to 150 mm;
- generates a strong magnetic field without damaging the uniformity of the magnetic field at the surface of the contact;
- overcomes the risks of distortion and/or variation in height while the winding is being manipulated.

Figure 4A:
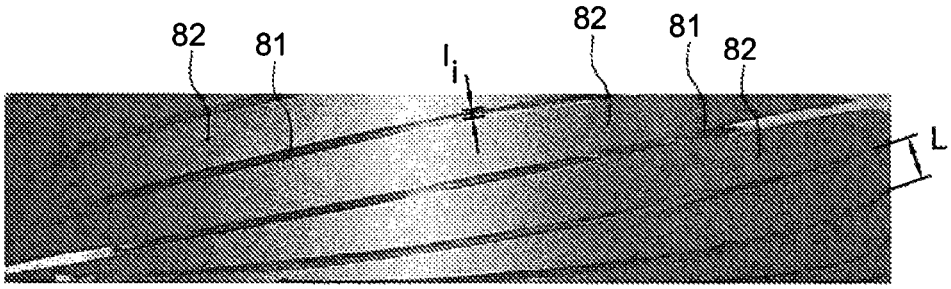
FIGS. 4A and 4B are side view of a copper-based winding respectively before and after implementation of the method of the invention.
Figure 4B:
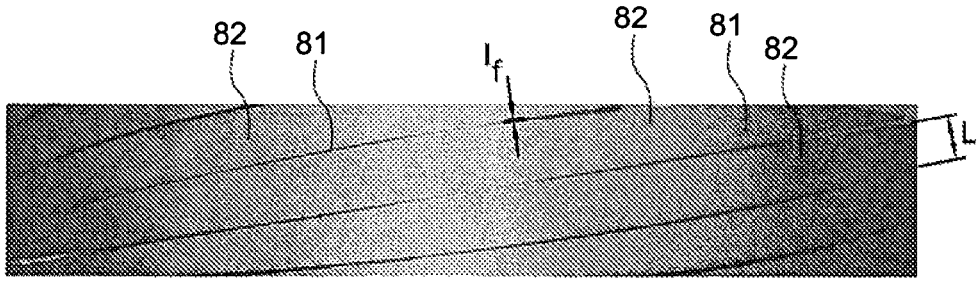

In order to satisfy this aim of the invention, the inventors decided to reduce the width of the slots 81 of a copper-based winding 8 manufactured using existing techniques (FIG. 4A) so that once implanted in a contact of the invention, the winding presents slots 81 of final width lf reduced to at most one millimeter (FIG. 4B).

The hollow cylinder constituting the copper-based winding 8 is usually made using metal slitting saws occupying about 1 mm to 1.2 mm that thus give an initial width li of the same order of magnitude to the slots 81 (FIG. 4A).

In addition, each turn 82 defined between two consecutive slots 81 has an average width L of about 4 mm.

The inventors considered that this slot 81 width fi was behind the problem of the invention: wide slots of about 1 mm to 1.2 mm have the effect of weakening the winding when it is manipulated, of reducing the mechanical endurance of the contact provided with said winding, and of generating a magnetic field that is not necessarily high and that is sometimes asymmetrical.

In order to reduce the width of slots to less than one millimeter and preferably to the range 0.1 mm to 0.2 mm, the inventors chose to make the slots by making a winding 8 made in the usual manner, and compressing it. Directly cutting slots 81 of very small individual width is, from point of view of the inventors, technically difficult to perform and is always very costly because it requires the use of very expensive metal slitting saws. Further, it is not even certain that the use of metal slitting saws at these diameters of less than one millimeter are compatible with a copper-based cylinder.

Figure 4C:
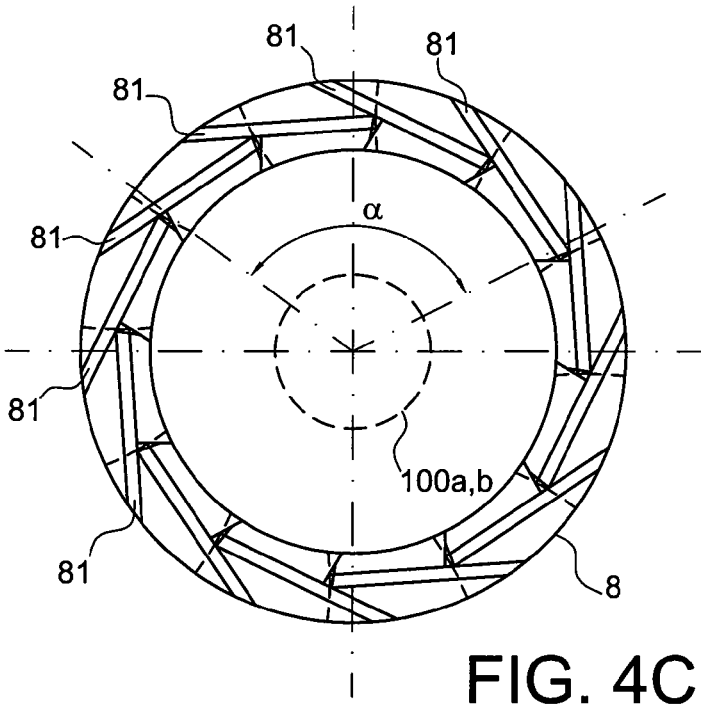
FIG. 4C is a view in cross-section of a copper-based winding of the invention projected into a plane.

FIG. 4C is a diagram in cross-section of a winding 8 of the invention, the section being projected into the same plane.

In this section, it can be seen that the slot portions 81 are uniformly distributed over the diameter of the windings 8 (12 of them) and that they are all of the same size. The angular length of a slot 81 is α equal to about 115°.

Figure 5A:
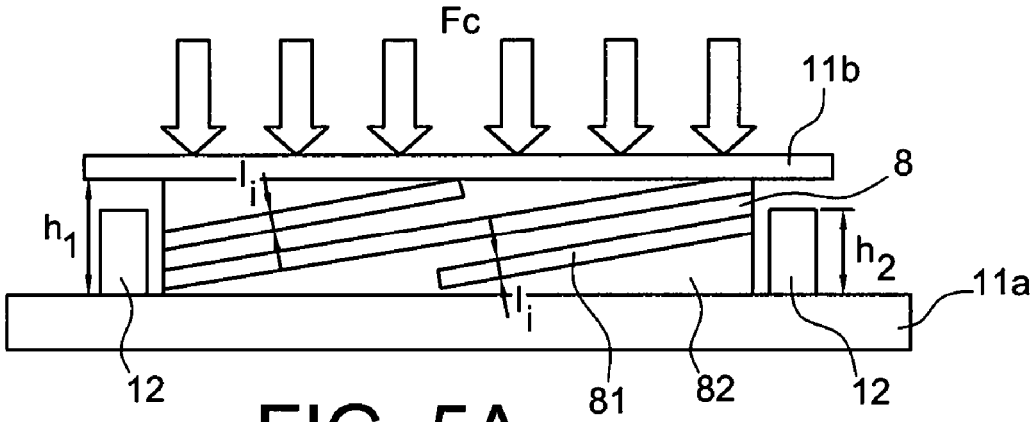
FIGS. 5A and 5B show two fabrication steps of a cold method of fabricating a copper-based winding of the invention.
Figure 5B:
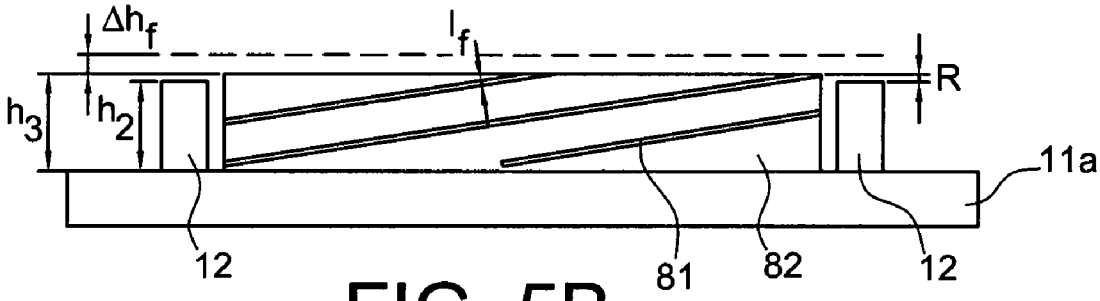

A cold method of fabricating a copper-based winding of the invention is shown in FIGS. 5A and 5B.

The compression of a winding 8 of first height h1 and including slots with a width li of about 1 mm to 1.2 mm is performed by a press between two platens 11*a*, 11*b* with a force Fc that is determined as a function of the coefficient of resistance to compression of the copper constituting the winding. The compression is performed until the bottom platen 11*b* comes into contact against spacers 12 of calibrated height h2. After natural relaxation of the winding 8 over a distance r, the winding takes on its final height h3.

Typically, for this cold compression method, the difference in height Δh=h1−h3 is between 2.5 mm and 4 mm.

Figure 6A:
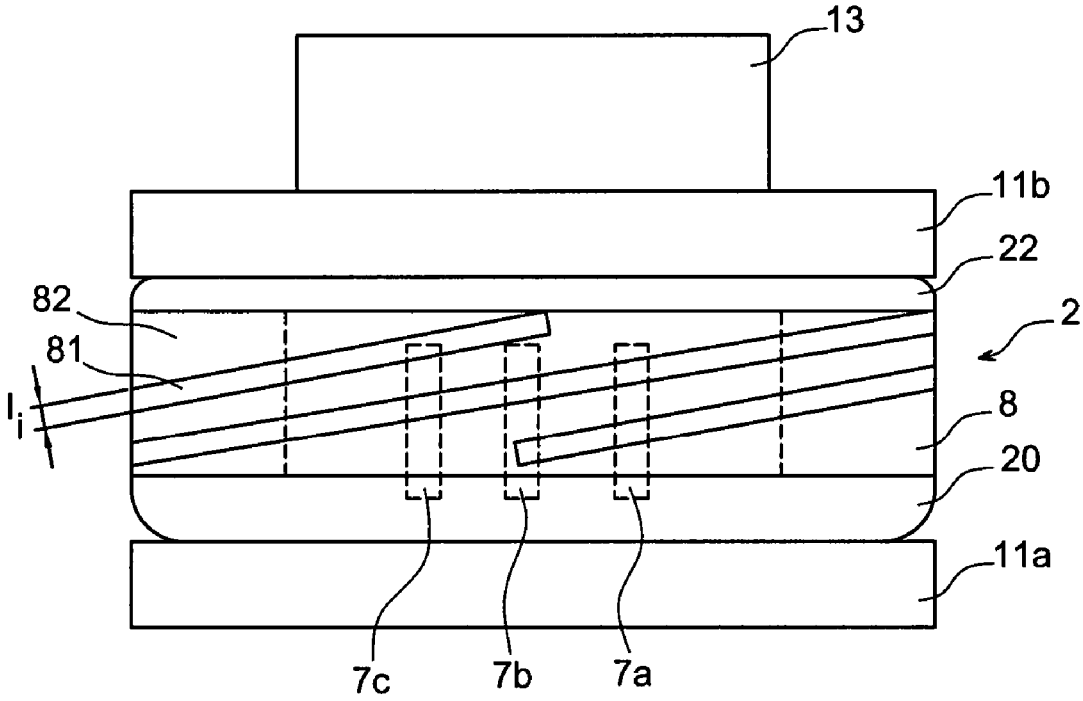
FIGS. 6A and 6B show two fabrication steps of a hot method of fabricating a contact including a copper-based winding of the invention.
Figure 6B:
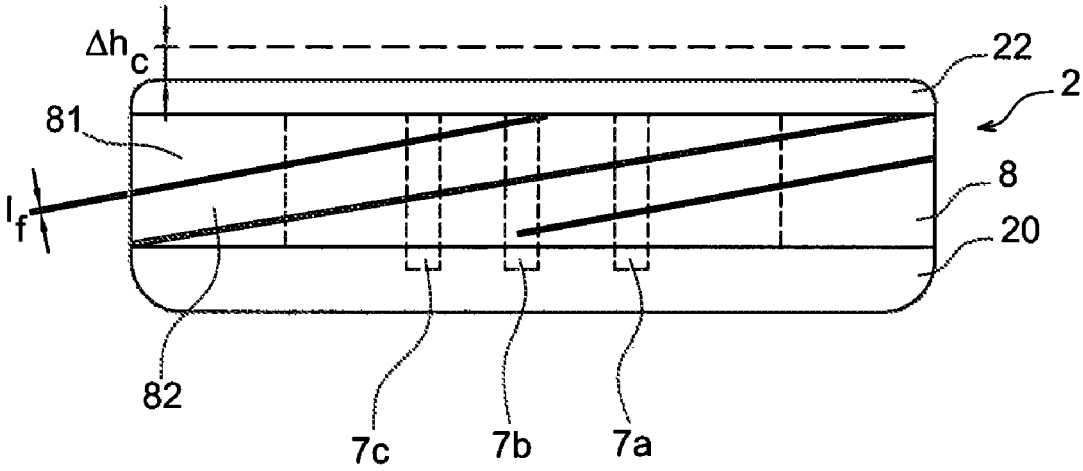

A hot method of fabricating a copper-based winding of the invention is shown in FIGS. 6A and 6B. In the method of the invention, the hollow cylinder 8 is fastened to the circular contact plate 22 and to the mechanical connection portion 20 by brazing, and during the brazing cycle the winding 8 is compressed.

In the patent application filed on the same day as the present application and entitled "A contact for medium-voltage vacuum circuit-breaker with reinforced structure, and an associated circuit breaker or vacuum circuit-breaker, such as an AC generator disconnector circuit-breaker", the inventors propose at least one stud 7*a*, 7*b*, 7*c* distinct from the winding(s) in the hollow of the first cylinder 8, as a spacer between the mechanical connection portion 20 and the circular plate 22, 32 of the contact body in such a manner as to avoid collapse thereof during a closing operation and in the closed position of the vacuum circuit-breaker, the stud(s) having high electrical resistance such that when a given current flows in the contact, the amount of current that flows in the stud(s) is negligible relative to the current that flows in the winding(s).

In the hot fabrication method of the invention the studs 7*a*, 7*b*, and 7*c* are advantageously used as calibrated spacers. Thus, the contact 2 shown in FIG. 6A with slots 81 of width li greater than one millimeter, is placed in the brazing oven and between two platens 11*a*, 11*b*.

The top platen 11*b* is surmounted by an appropriate mass 13, typically in the range 2 kg to 5 kg.

During the temperature rise in the oven, the winding 8 subsides under the weight of the mass 13 and of the plate 22, and the width of the slots 81 is reduced to below one millimeter.

The subsiding stops when the circular plate 22 comes into abutment with the studs 7*a*, 7*b*, 7*c*.

The cycle of brazing the portions 20 and 22 to the winding 8 thus continues with the brazing operation proper. At the end of the cycle when the contact 2 is removed from the oven, the definitive width lf of the slots 81 is reached and is typically of the order 0.1 mm to 0.2 mm (FIG. 6B). Typically, the difference Δhc in height of the contact 2 between being placed in the brazing oven and (FIG. 6A) and being removed (FIG. 6B) is between 2.5 mm and 4 mm.

Figure 7:
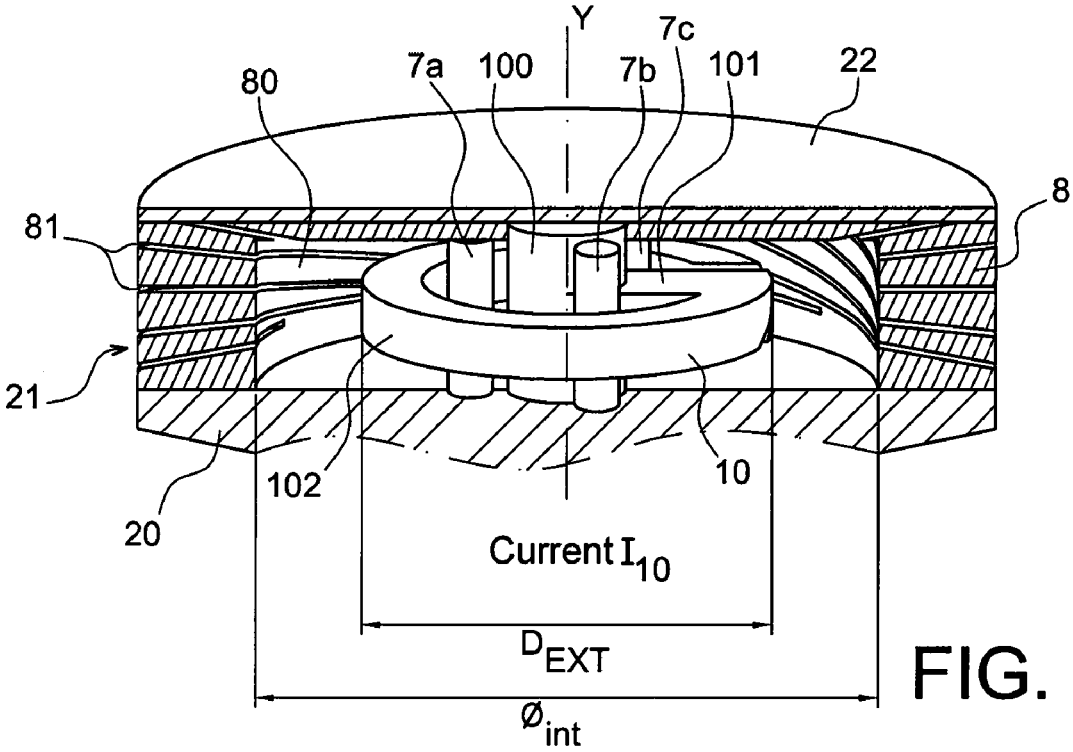
FIG. 7 is a part-sectional perspective view of a contact in yet another embodiment comprising a copper-based winding of the invention.

FIG. 7 shows a contact 2 made using the hot method with the stud 7*a*, 7*b*, 7*c* and further including a second winding constituted of the solid part 10 described above in reference to FIG. 3. In this embodiment, three identical studs 7*a*, 7*b*, 7*c* are implanted as spacers in the body of the contact 22. More precisely, these three studs 7*a*, 7*b*, 7*c* are situated on a common circumference at 120° from one another and inside the annular ring 102, i.e. between the cylindrical portions 100*a* and 100*b* and the annular ring 102.

Figure 7A:
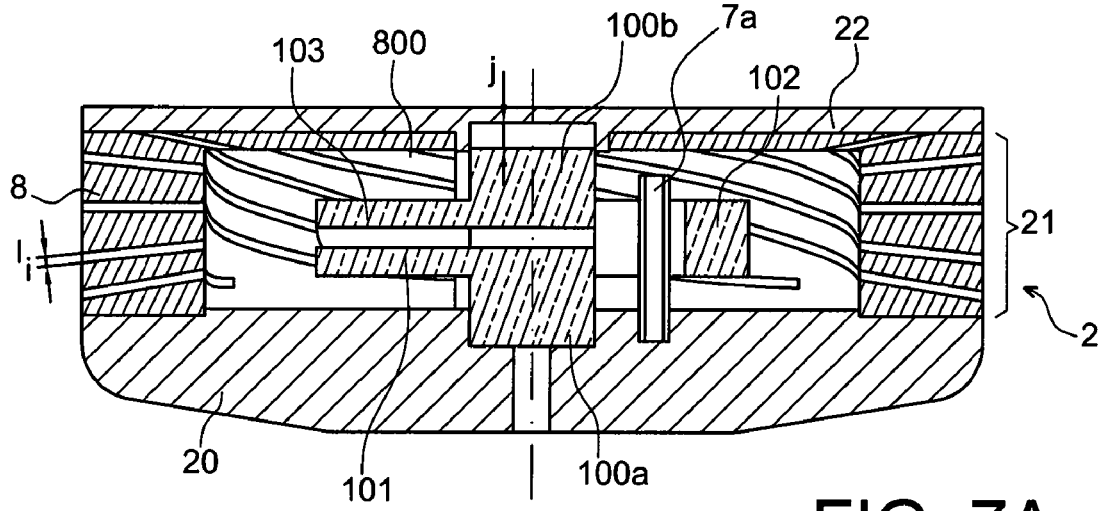
FIGS. 7A and 7B show two fabrication steps of a method of fabricating a contact of FIG. 7.

As can be seen in FIG. 7A, a gap j is initially provided between the studs 7 and the top cylindrical portion 100*a* in order to enable the winding 8 to subside under the weight of the mass 13 and of the plate 22.

Figure 7B:
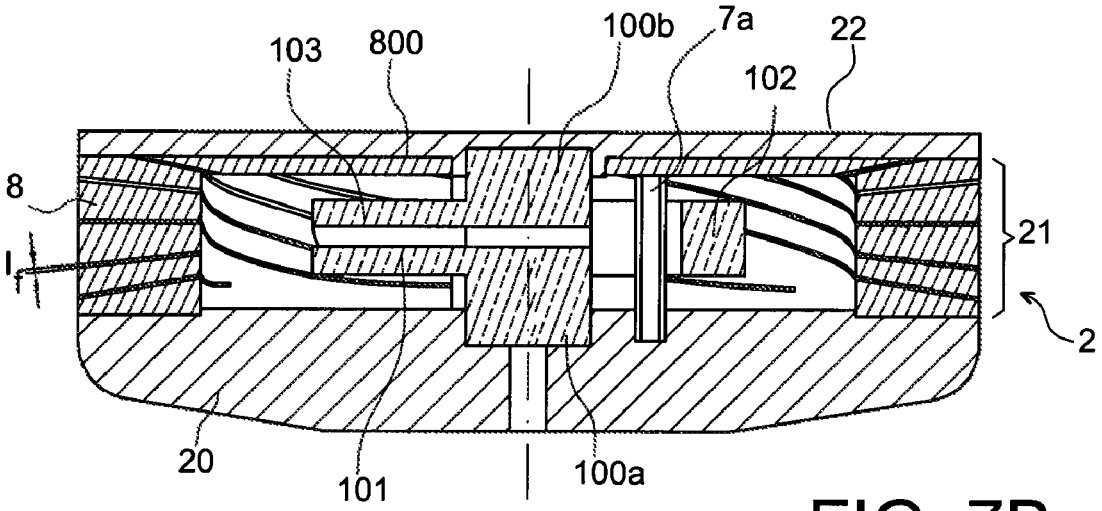

Thus, as visible in section in FIG. 7B, when removed from the brazing oven, the various components (studs 7, cylindrical portions 100*a* and 100*b*, winding 8, plate 22, and mechanical connection portion 20) are brazed together and no gap remains.

The above-described invention enables the following advantages to be obtained:

- increasing the mechanical stability of a vacuum circuit-breaker contact including a copper-based winding; this mechanical stability enables ANSI and CEI standards to be met. The mechanical strength of the vacuum circuit-breaker is thus significantly improved to allow 30000 opening/closing cycles to be performed;
- improving the magnetic field generated by a copper-based winding of the invention: by conserving the same number of slots but by reducing its height, the winding generates a higher and better-distributed magnetic field, which enables effective arc current extinction; and
- reducing the probability of an arc being created at the periphery of a contact.

The invention claimed is:

1. A copper-based winding, of diameter greater than 90 mm, intended to generate a magnetic field in an electrical contact for a medium voltage vacuum circuit-breaker, the winding comprising a hollow cylinder including helical slots made methodically about its longitudinal axis and opening out both to the hollow and to the exterior of the cylinder, in which winding the space between two consecutive turns that constitutes a slot is empty of material and the width of each slot is less than 0.2 mm for an outside diameter $Ø_{ext}$ of the hollow cylinder that is greater than 90 mm, the winding being made from a hollow cylinder of an initial height hl with helical slots about its longitudinal axis, the helical slots opening out both to the hollow and to the exterior of the hollow, the space between two consecutive turns being empty of material and the width of each initial slot being greater than 1 mm; the hollow cylinder being compressed until it reaches a calibrated intermediate height h2 so that after release of compression of the hollow cylinder, the width of each final slot is less than 1 mm.

2. A winding according to claim 1, wherein the width of a turn is on average at least 3 mm, and typically greater than 4 mm.

3. A medium-voltage vacuum circuit-breaker, including at least one electrical contact, for a medium-voltage vacuum circuit-breaker, the contact extending along a longitudinal axis Y and comprising:

- a mechanical connection portion that extends along the longitudinal axis Y; and
- a contact body that includes:
- a first winding according to claim 1; and
- a circular contact plate of the same diameter as that of the exterior of the first hollow cylinder, said plate being also centered on the longitudinal axis Y and being fastened to the end of the first hollow cylinder opposite from the end fastened to the mechanical connection portion.

4. A circuit-breaker, such as an AC generator disconnector circuit-breaker including at least one vacuum circuit-breaker, including at least one electrical contact, for a medium-voltage vacuum circuit-breaker, the contact extending along a longitudinal axis Y and comprising:

a mechanical connection portion that extends along the longitudinal axis Y; and a contact body that includes:

a first winding according to claim 1; and a circular contact plate of the same diameter as that of the exterior of the first hollow cylinder, said plate being also centered on the longitudinal axis Y and being fastened to the end of the first hollow cylinder opposite from the end fastened to the mechanical connection portion.

5. A vacuum circuit-breaker according to claim 3 comprising a pair of electrical contacts with a stationary contact and a movable contact.

6. A vacuum circuit-breaker according to claim 3 through which a short-circuit current flows in the event of a fault, and where appropriate through which the nominal load current flows.

7. A method of making a copper-based winding intended to generate a magnetic field in an electrical contact for a medium-voltage vacuum circuit-breaker, the method comprising the following steps:

a) making a hollow cylinder of an initial height hl with helical slots about its longitudinal axis and opening out both to the hollow and to the exterior of the hollow, the space between two consecutive turns being empty of material and the width of each initial slot being greater than 1 mm;

b) compressing the hollow cylinder until it reaches a calibrated intermediate height h2 so that after release of compression of the hollow cylinder, the width of each final slot is less than 1 mm.

8. A method according to claim 7, wherein cold compression step b) is carried out and the compression release also being carried out cold by natural relaxation of the hollow cylinder.

9. A method according to claim 7, wherein the following are carried out:

step a) with an initial individual slot width lying in the range 1 mm and 1.2 mm for an outside diameter of the hollow diameter $Ø_{ext}$ of the hollow cylinder greater than 90 mm; and step b) such that the width of each final slot is less than 0.2 mm.

10. A method of making an electrical contact for a medium-voltage vacuum circuit-breaker, the contact extending along a longitudinal axis Y and including:

a mechanical connection portion that extends along the longitudinal axis Y;

a contact body comprising a winding consisting of a hollow cylinder that includes helical slots about its axis and opening out both to the hollow and to the exterior of the cylinder, the space between two consecutive turns that constitute a slot is empty of material and the width of each slot is less than 1 mm, the first hollow cylinder being centered on the longitudinal axis Y by having an end that is fastened to the mechanical connection portion, the hollow of the first cylinder being empty of material; and a circular contact plate that has a diameter equal to the outside of the first hollow cylinder, said plate also being centered on the longitudinal axis Y and being fastened to the end of the first hollow cylinder opposite the plate fastened to the mechanical connection portion;

wherein the fastening of the hollow cylinder to the circular contact plate and to the mechanical connection portion is carried out by brazing, and during the brazing cycle, step b) of the method of making a winding is carried out according to claim 7.

11. An electrical contact for a medium-voltage vacuum circuit-breaker, the contact extending along a longitudinal axis Y and comprising:

a mechanical connection portion that extends along the longitudinal axis Y; and a contact body that includes:

a first copper-based winding, of diameter greater than 90 mm, intended to generate a magnetic field in an electrical contact for a medium voltage vacuum circuit-breaker, the winding including a hollow cylinder including helical slots made methodically about its longitudinal axis and opening out both to the hollow and to the exterior of the cylinder, in which winding the space between two consecutive turns that constitutes a slot is empty of material and the width of each slot is less than 0.2 mm for an outside diameter $Ø_{ext}$ of the hollow cylinder that is greater than 90 mm;

a circular contact plate of the same diameter as that of the exterior of the first hollow cylinder, said plate being also centered on the longitudinal axis Y and being fastened to an end of the first hollow cylinder opposite from the end fastened to the mechanical connection portion; and a second winding constituted by an additional solid part, which comprises two cylindrical ortions and an annular ring that is not looped and that is centered on the two cylindrical portions, each end of the non-looped ring being fastened by an arm to one of the cylindrical portions, the arrangement of this additional part being such that the two cylindrical portions are centered on the longitudinal axis Y and the annular ring arranged concentrically with the first winding, one of the cylindrical portions being fastened to the mechanical connection portion and the other of the cylindrical portions being fastened to the circular contact plate, the hollow of the first winding and the space between the annular ring and the two cylindrical portions being empty of material.

12. An electrical contact according to claim 11, wherein the second winding electrically connected in parallel with the first winding and adapted to generate a magnetic field that is superposed on the magnetic field generated by the first winding.

13. An electrical contact according to claim 12, wherein the second winding is a copper-based winding, of diameter greater than 90 mm, intended to generate a magnetic field in an electrical contact for a medium voltage vacuum circuit-breaker, the winding consisting of a hollow cylinder including helical slots made methodically about its longitudinal axis and opening out both to the hollow and to the exterior of the cylinder, in which winding the space between two consecutive turns that constitutes a slot is empty of material and the width of each slot is less than 0.2 mm for an outside diameter $Ø_{ext}$ of the hollow cylinder that is greater than 90 mm, the second hollow cylinder being centered on the longitudinal axis Y, concentric with the first cylinder, having one end fastened to the mechanical connection portion and the other end fastened to the circular plate, the hollows of the cylinders being empty of material.

14. An electrical contact according to claim 11, wherein the outside diameter of the first winding and of the circular plate lies in the range 90 mm to 150 mm.

15. An electrical contact for a medium-voltage vacuum circuit-breaker, the contact extending along a longitudinal axis Y and comprising:

a mechanical connection portion that extends along the longitudinal axis Y; and a contact body that includes:

a first copper-based winding, of diameter greater than 90 mm, intended to generate a magnetic field in an electrical contact for a medium voltage vacuum circuit-breaker, the winding including a hollow cylinder including helical slots made methodically about its longitudinal axis and opening out both to the hollow and to the exterior of the cylinder, in which winding the space between two consecutive turns that constitutes a slot is empty of material and the width of each slot is less than 0.2 mm for an outside diameter $Ø_{ext}$ of the hollow cylinder that is greater than 90 mm, the winding being made from a hollow cylinder of an initial height hl with helical slots about its longitudinal axis, the helical slots opening out both to the hollow and to the exterior of the hollow, the space between two consecutive turns being empty of material and the width of each initial slot being greater than 1 mm; the hollow cylinder being compressed until it reaches a calibrated intermediate height h2 so that after release of compression of the hollow cylinder, the width of each final slot is less than 1 mm;

a circular contact plate of the same diameter as that of the exterior of the first hollow cylinder, said plate being also centered on the longitudinal axis Y and being fastened to an end of the first hollow cylinder opposite from the end fastened to the mechanical connection portion; and a second copper-based winding electrically connected in parallel with the first winding and adapted to generate a magnetic field that is superposed on the magnetic field generated by the first winding, the second winding being of diameter greater than 90 mm, intended to generate a magnetic field in an electrical contact for a medium voltage vacuum circuit-breaker, the second winding consisting of a hollow cylinder including helical slots made methodically about its longitudinal axis and opening out both to the hollow and to the exterior of the cylinder, in which winding the space between two consecutive turns that constitutes a slot is empty of material and the width of each slot is less than 0.2 mm for an outside diameter $Ø_{ext}$ of the hollow cylinder that is greater than 90 mm, the second hollow cylinder being centered on the longitudinal axis Y, concentric with the first cylinder, having one end fastened to the mechanical connection portion and the other end fastened to the circular plate, the hollows of the cylinders being empty of material.

* * * * *